US008134245B2

(12) United States Patent
Rangel

(10) Patent No.: US 8,134,245 B2
(45) Date of Patent: Mar. 13, 2012

(54) DEVICE AND METHOD FOR GENERATING RECIPROCATING MOTION

(76) Inventor: Michael J. Rangel, Chicago, IL (US)

( * ) Notice: Subject to any disclaimer, the term of this patent is extended or adjusted under 35 U.S.C. 154(b) by 403 days.

(21) Appl. No.: 12/383,230

(22) Filed: Mar. 20, 2009

(65) Prior Publication Data

US 2010/0237630 A1 Sep. 23, 2010

(51) Int. Cl.
*F03B 13/00* (2006.01)
*F04B 9/00* (2006.01)
*F04B 35/00* (2006.01)

(52) U.S. Cl. ..... 290/42; 290/53; 60/495; 60/496; 60/497; 417/331

(58) Field of Classification Search ..... 290/42, 290/43, 48, 53, 54; 60/495–497, 501, 502, 60/505
See application file for complete search history.

(56) References Cited

U.S. PATENT DOCUMENTS

| | | | | |
|---|---|---|---|---|
| 859,396 | A | 7/1907 | Lynch | |
| 1,058,785 | A | 4/1913 | Nevers | |
| 4,324,099 | A | 4/1982 | Palomer | |
| 4,425,510 | A * | 1/1984 | Jury | 290/42 |
| 4,838,025 | A * | 6/1989 | Nelis | 60/505 |
| 7,012,341 | B2 * | 3/2006 | Matsubara | 290/43 |
| 7,464,546 | B2 * | 12/2008 | Peacock | 60/496 |

* cited by examiner

*Primary Examiner* — Tran Nguyen
(74) *Attorney, Agent, or Firm* — Joan I. Norek; The Law Office of Joan I Norek

(57) ABSTRACT

A device for generating substantially vertically-reciprocating motion uses a plurality of chambers in substantial vertical alignment. Each chamber has an air pocket and a buoyant member which floats at the air/water interface, and such air pockets expand and contract upon receipt of additional amounts of air from below and release of some of the air, usually to a chamber above. As the air pockets expand and contract, the interfaces are raised and lowered, and the buoyant elements are raised and lowered with the interfaces. A method uses such device to generate such reciprocating motion, which optionally may be used to drive electric generators.

11 Claims, 4 Drawing Sheets

DEVICE AND METHOD FOR GENERATING RECIPROCATING MOTION

BACKGROUND OF THE INVENTION

The present invention relates to devices and methods for generating energy, that is, for producing or capturing currently needed forms of energy, such as electricity, from less serviceable energy sources.

SUMMARY OF THE INVENTION

The present invention provides a substantially non-polluting device, and a method using the device, for generating substantially vertically-reciprocating motion, and in further embodiment for converting or transforming the kinetic energy of such reciprocating motion into, and at times accumulating, other energy forms, such as the currently in-demand electricity. The substantially vertically-reciprocating motion is the motion of one or more buoyant objects (floats, floating bodies) floating in a liquid, which liquid is preferably water.

The present invention also provides a unique method in which the release of a gaseous material to the liquid, and its subsequent and inevitable rise through the liquid, compels or drives the substantially vertically-reciprocating motion. When that gaseous material is atmospheric air, its eventual release in substantially unadulterated form to atmosphere is non-polluting.

The present invention also provides a unique device with which the method is practiced.

DETAILED DESCRIPTION OF THE INVENTION

Figure 1:
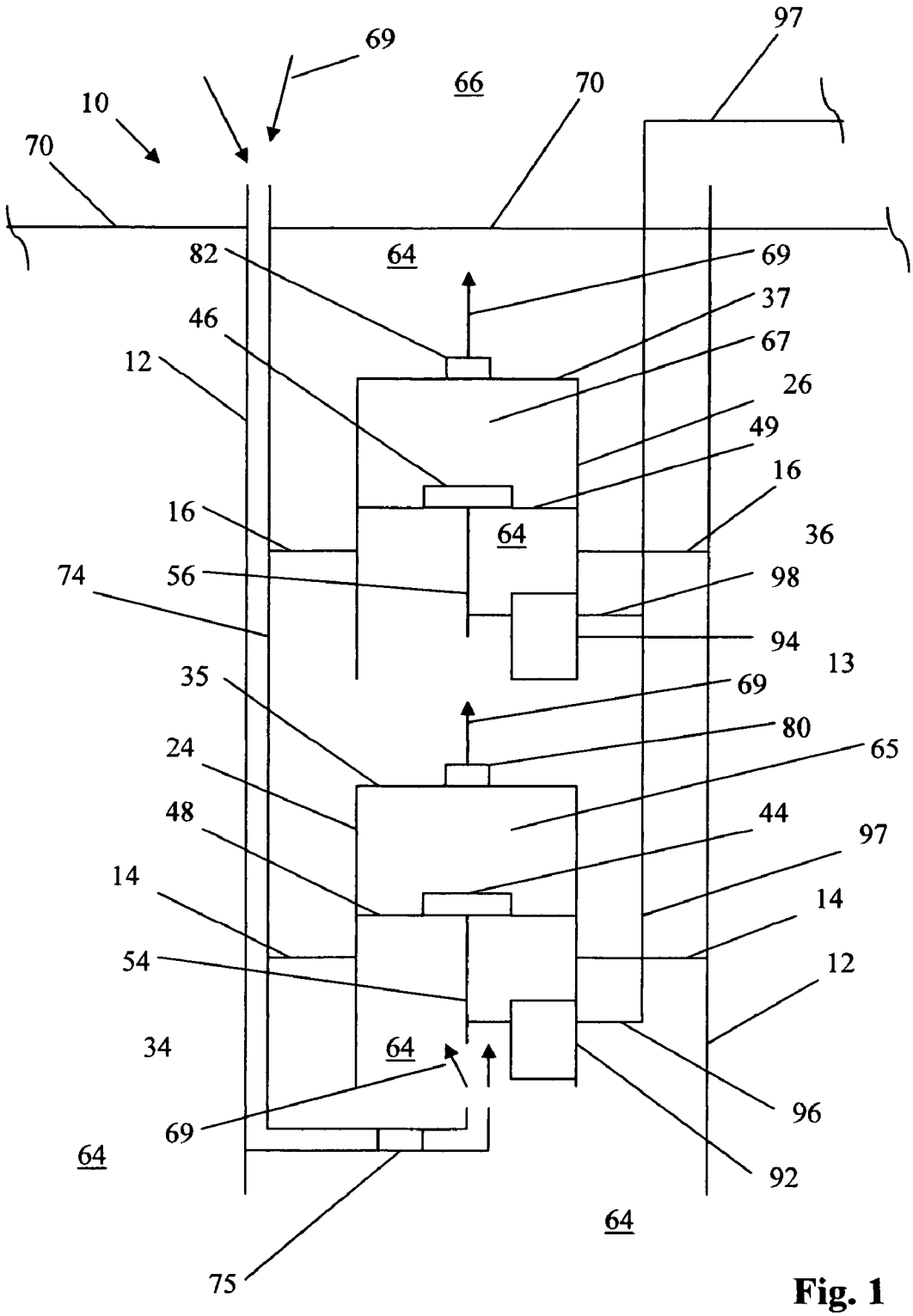
FIG. 1 is a diagrammatic view of a device of the present invention in a repose mode.
Figure 2:
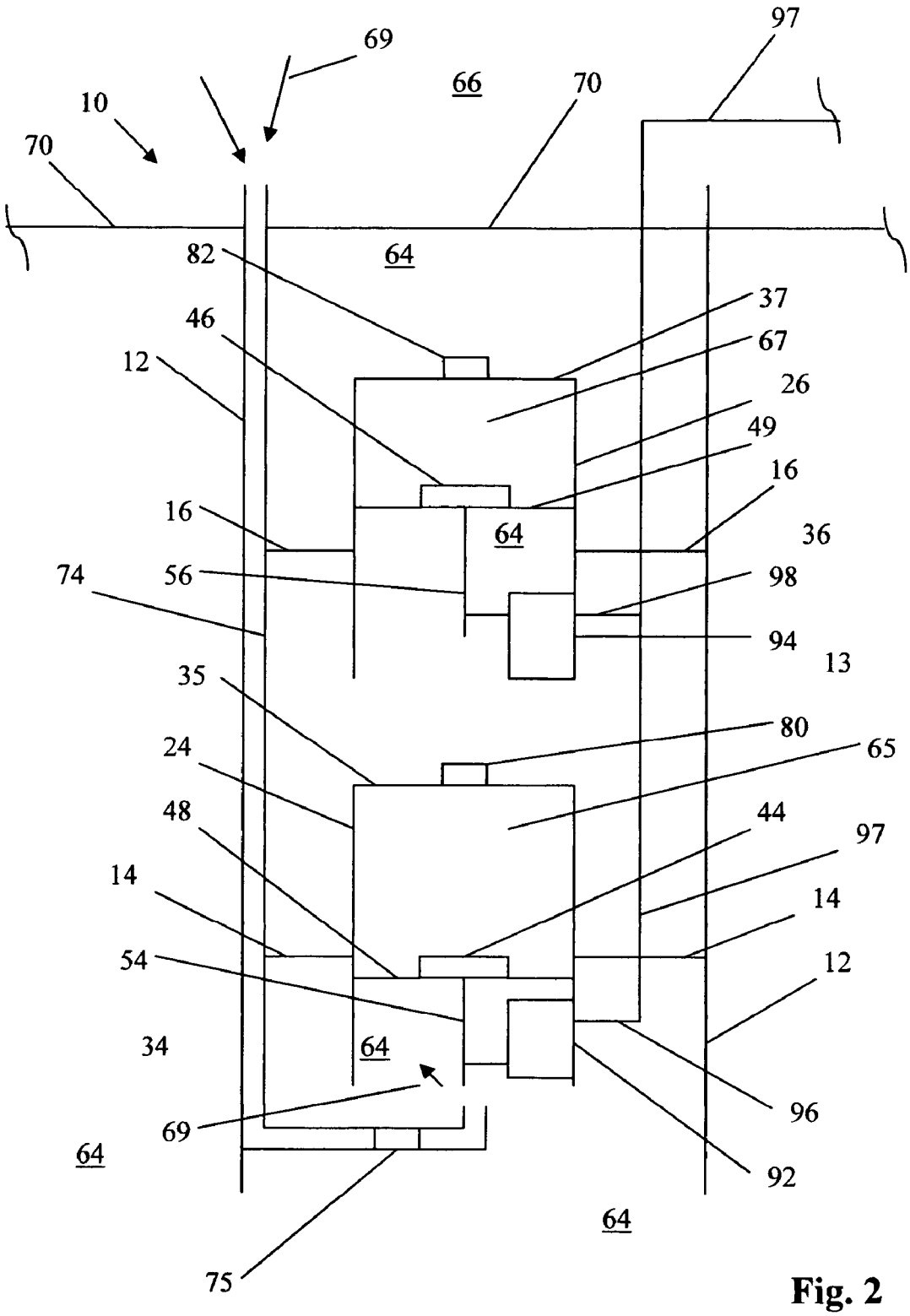
FIG. 2 is a diagrammatic view of the device of FIG. 1 in a pressurized first-chamber mode.
Figure 3:
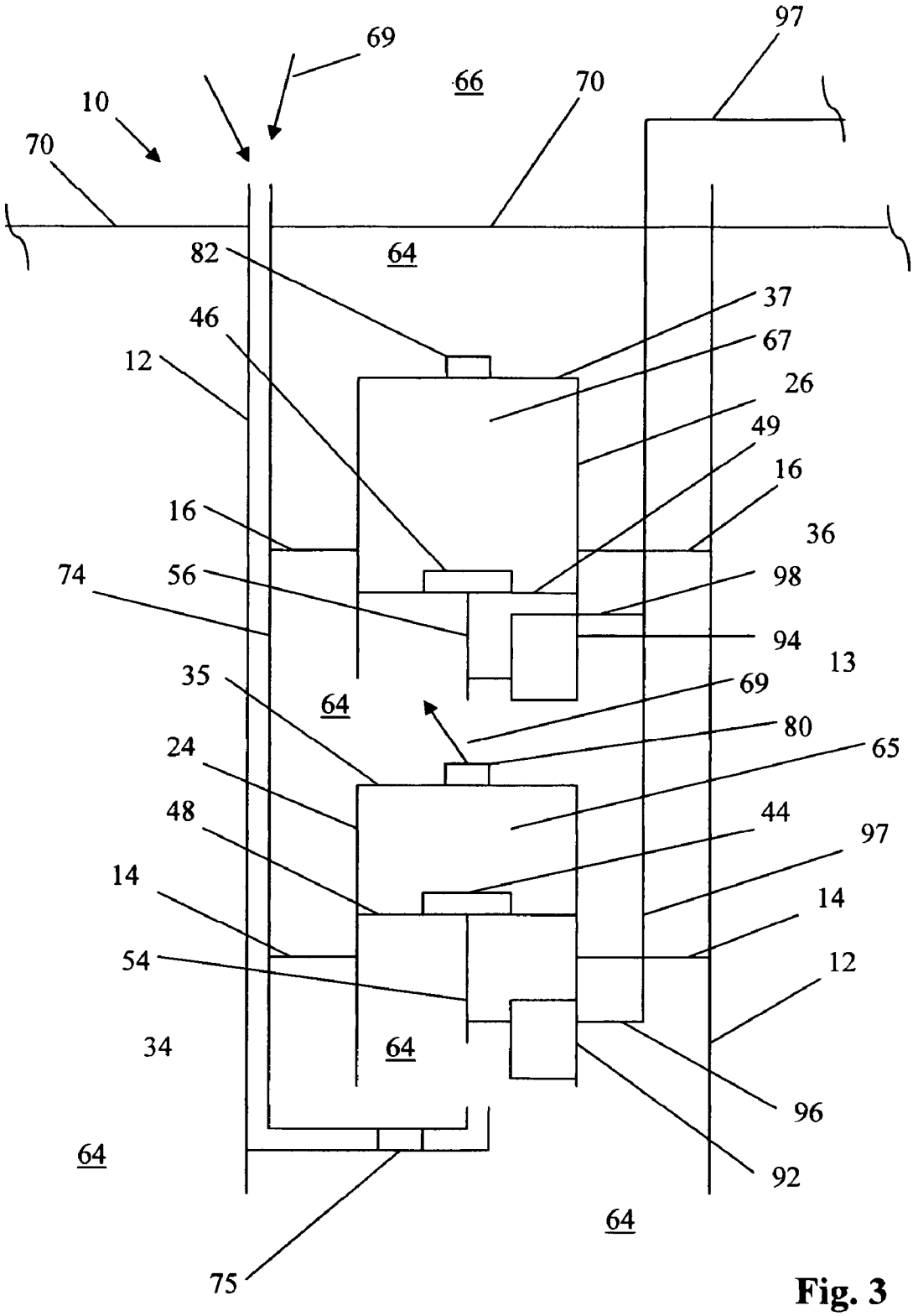
FIG. 3 is a diagrammatic view of the device of FIG. 1 in a pressurized second-chamber mode.

Referring now to FIG. 1 to FIG. 3, there is shown a device of the present invention which is designated generally by the reference numeral 10. The device 10 of the present invention is a device which, in use, generates substantially vertically-reciprocating motion and, as depicted, converts or transforms the kinetic energy of such reciprocating motion into a flow of electricity. Therefore the device 10 of the present invention, being mechanical, is a machine, and more particularly, as described below, a hydraulic machine.

The device 10 of the embodiment of the invention shown in FIG. 1 to FIG. 3 has an external casing or vertical shield or housing 12 which is depicted as elongated and disposed in a substantially upright vertical orientation. The housing 12 as shown has a vertically elongate shape, such as cylindrical or columnar shape. Housings of other shapes, configurations and cross-section profiles are not, however, excluded from the present invention, although seldom would there be a practical reason to use a housing that is not cylindrical or columnar. The housing 12 of the device 10 shown in FIG. 1 to FIG. 3 is disposed substantially upright, and is open to the outer environs at each opposed end. The housing 12 is substantially water-impermeable and water-impervious, and in preferred embodiments is not substantially affected by prolonged immersion in water. The housing 12 therefore is preferably constructed from a suitable nonporous and sufficiently rigid material, or combination of materials, such as plastic, metal, metal alloy, wood, ceramic, glass and the like which are water-resistant or waterproof, such as by being naturally water-resistant or waterproof or having a sufficiently water-resistant or waterproof coating or finish. The housing 12 also is sufficiently firm or rigid to substantially retain a sufficient degree of structural integrity under the conditions of its use in the practice of the method of the present invention.

The device 10 of the embodiment of the invention shown in FIG. 1 to FIG. 3 has a plurality of crosspieces, crossbars, fittings, support or mechanical mounting elements 14, 16 which are disposed within the housing 12, and preferably are orientated substantially along the horizontal when the housing 12 is positioned substantially along the vertical. The support elements 14, 16 as seen in FIG. 1 to FIG. 3 are spaced apart from each other, are disposed substantially parallel to each other, extend out from the internal surface or wall 13 of the housing 12, which internal wall 13 is a typical continuous wall of a cylinder. Each support element 14, 16 separately holds and supports one of the downwardly-open chambers 24, 26, keeping the downwardly-open chambers 24, 26 in a fixed or stationary position or posture relative the housing 12. In other words, the downwardly-open chambers 24, 26 in this embodiment are disposed, and stationarily fixed, along the horizontal and along the vertical relative the housing 12, and are spaced-apart from the internal surface of the housing 12.

The support elements 14, 16 as shown in FIG. 1 to FIG. 3 are substantially water-impermeable and water-impervious, and in preferred embodiments are not substantially affected by prolonged immersion in water. The support elements 14, 16 therefore are preferably constructed from a suitable nonporous and sufficiently rigid material, or combination of materials, such as plastic, metal, metal alloy, wood, ceramic, glass and the like which are water-resistant or waterproof, such as naturally water-resistant or waterproof, or by having a sufficient water-resistant or waterproof coating or finish. The support elements 14, 16 also are sufficiently rigid to substantially retain a sufficient degree of structural integrity under the conditions of its use in the practice of the method of the present invention.

Each chamber 24, 26 is constructed of substantially air-tight material. The chambers 24, 26 are also substantially water-impermeable and water-impervious, and in preferred embodiments are not substantially affected by prolonged immersion in water. The chambers 24, 26 therefore are preferably constructed from a suitable nonporous and sufficiently rigid material, or combination of materials, such as plastic, metal, metal alloy, wood, ceramic, glass and the like which are water-resistant or waterproof, such as naturally water-resistant or waterproof, or by having a sufficient water-resistant or waterproof coating or finish. The chambers 24, 26 also are sufficiently rigid to substantially retain a sufficient degree of structural integrity under the conditions of its use in the practice of the method of the present invention.

The chambers 24, 26 are, as mentioned above, disposed downwardly open. In other words, each of the chambers 24, 26 has a respective mouth 34, 36, and that respective mouth 34, 36 is open to the region immediately below the respective chamber 24, 26. The chambers 24, 26 as shown in FIG. 1 to FIG. 3 preferably would be cylindrical, have substantially the same size and configuration, are held spaced apart from each other, one under the other, and substantially lie along the same vertical axis.

Each of the chambers 24, 26 is partially filled with water 64 and contains and encloses a respective buoyant element 44, 46 from which downwardly extends a respective piston 54, 56. Each of the buoyant elements 44, 46 floats on the water 64 and each of the pistons 54, 56, as shown in FIG. 1 to FIG. 3, partially extends out through the mouth 34, 36 of its respective chamber 24, 26. As shown in FIG. 1 to FIG. 3, the buoyant elements 44, 46 are flat-side disks of modest, but not negligible, thickness. As their configurations are shown in FIG. 1 to FIG. 3, the buoyant elements 44, 46 are each short or somewhat flat, for example a flat cylindrically-shaped discs, having (horizontal) diameters which are small enough to float within their respective chambers 24, 26. Each of the buoyant elements 44, 46 is buoyant, having a density which is less than the liquid in which it floats, which, as described here and preferably, is the water 64. The required buoyancy of course can be provided by an internal cavity or hollow filled with air or other gas, or alternatively filled with a low density solid, such as cork and the like. The buoyant elements 44, 46 are also substantially water-impermeable and water-impervious, and in preferred embodiments are not substantially affected by prolonged submersion in water, unless it is desired that the buoyant elements be wetted by, or absorb, an amount of water that increases the weight of the elements 44, 46 without loss of buoyancy, or the circumstances are at least open to such possibilities. The buoyant elements 44, 46 therefore are preferably constructed, at least externally, from a suitable nonporous and sufficiently rigid material, or combination of materials, such as certain plastics or woods and the like which are water-resistant or waterproof, such as naturally water-resistant or waterproof materials, or by having a sufficient water-resistant or waterproof coating or finish. Other construction materials such as metal, metal alloy, ceramic and glass, which typically are not buoyant, can be used provided the resultant buoyant elements 44, 46 are buoyant, for instance, as mentioned above, by virtue of a hollow, air-filled core.

The buoyant elements 44, 46 could even be pieces of ice, although such an embodiment would generally be short-lived because ice in contact with water will generally melt with at least modest rapidity. If the water temperature approached the freezing point, the melting of the ice would be slowed but not stopped.

The chambers 24, 26 also are sufficiently rigid to substantially retain a sufficient degree of structural integrity under the conditions of its use in the practice of the method of the present invention.

As shown in FIG. 1 to FIG. 3, the buoyant elements 44, 46 each float freely, spaced apart from the internal or inner surfaces 28, 30 of their respective chambers 24, 26, or at least are not so tethered or otherwise attached to their respective chambers 24, 26 so as to unduly impeded reciprocating motion of the buoyant elements 44, 46 (which reciprocating motion is described below). The buoyant elements 44, 46 also, as mentioned above, have (horizontal) diameters which are less than the inside diameters of the chambers 24, 26 in which they float, whereby there are spaces between the buoyant elements 44, 46 and the inner surfaces 28, 30 of the chambers 24, 26 which, as discussed further below, fulfills an operating condition of the method of the present invention. There must be a fluid pathway between the lower and the upper reaches of the chambers 24, 26 through which a gas can pass through. The boundaries 48, 49 between the upper and lower reaches of the chambers 24, 26 are defined by the buoyant elements 44, 46 and interfaces between the water 64 and the air above the water 64 in air pockets 65, 67 of the respective chamber 24, 26.

As mentioned above, from each of the buoyant elements 44, 46 respective rods or pistons 54, 56 extend downwardly. Each of the piston rods or pistons 54, 56 are rigidly affixed to its respective buoyant element 44, 46 and, as shown in FIG. 1 to FIG. 3 and preferable, are orientated substantially normal to the bottom surface of the respective buoyant element 44, 46. Each piston 54, 56 is associated with elements that receive a transmission of the motion/energy of the reciprocating vertical motions of the respective piston 54, 56, and these elements are illustrated and described below.

As seen particularly in FIG. 1, wherein the device 10 is in a repose mode, the buoyant elements 44, 46 float on the water 64 inside of their respective chambers 24, 26 near but spaced-apart from the closed tops 35, 37 of the of the chambers 24, 26 because air pockets 65, 67 in the chambers 24, 26 prevent the water 64 from rising to the tops 35, 37.

A pipe or air tube or conduit 74 runs from a source of gaseous material, which here is atmosphere 66, to a position below the lowermost chamber 24. Since the lowermost chamber 24 is immersed in the water 64, the air conduit 74 traverses the interface of the water 70 and atmosphere 66, or in other words the surface of the water 70. As shown in FIG. 1 to FIG. 3, this conduit 74 is disposed within the housing 12 and runs down along the interior surface 13 of the housing 12, and turns inward and then upward without extending out of the lower end of the housing 12. The conduit 74 as shown in FIG. 1 to FIG. 3 extends from the free atmospheric air 66 above the water 64 down past the vertical alignment of chambers 24, 26 and then runs to a position under, and facing, the lowest (here the lower) chamber 24. In the embodiment of FIG. 1 to FIG. 3, the conduit 74 is shaped somewhat like a snorkel, and the support elements 14, 16 are either open-framework members or have apertures or the like through which the conduit 74 passes. Within the conduit 74 is an air pump 75 which routes delivered air 69 from the atmosphere 66 and releases delivered air 69 to a position below the lower chamber 24. Then the delivered air 69 rises through the water 64 into and up through the lower chamber 24 until it joins the air within the air pocket 65. Sufficient delivered air 69 is, in this manner, delivered to the lower chamber 24 to expand its air pocket 65 and depress its buoyant element 44, for instance as shown in FIG. 2. As described in more detail below, when the buoyant element 44 in the lower chamber 24 has been depressed downwardly to the desired or sufficient level, a valve 80 releases a portion of the air in the expanded air pocket 65 of the lower chamber 24, and such air, or delivered air 69, rises through the water 64 into and up through the higher or upper chamber 26 until it joins the air within its air pocket 67, such as is as shown in FIG. 3. Then when the buoyant element 46 in the upper chamber 26 has been depressed downwardly to the desired or sufficient level, a valve 82 releases a portion of the air in the expanded air pocket 67 of the upper chamber 26, and such air, or delivered air 69, rises through the water 64 up and out of the water 64, into the atmosphere 11. The routing of delivered air 69 is shown by the arrows tied to the reference number 69 in FIG. 1. In a repose mode such as shown in FIG. 1 there of course is either no air flowing, or either the commencement of air flowing to the lower chamber 24 or the near completion of air flowing out of the upper chamber 26 because the air pockets 65, 67 are both in a contracted, rather than expanded, mode. The arrows designating the flow of delivered air 69 are shown in FIG. 1 instead for reasons of simplicity and clarity.

It is noted here that the air conduit 74 need not be disposed within the housing 12 and could, instead, be disposed outside of the housing 12 and release the delivered air 69 to rise up to the lower chamber 24 from a point below the housing 12, or alternatively could turn up at its end sufficiently that the release of air 69 is made within the housing 12.

The delivered air 69 that is routed to the lower chamber 24 through the air conduit 74 must of course be pumped or otherwise driven, forced down or pulled down through the air conduit 74 because the pressure exerted by atmospheric air is low relative the water. (If a conduit such as air conduit 74 were open at the top to atmospheric air, and open at the bottom to subsurface water, as could be envisioned from FIG. 1 through FIG. 4, without a positive pressure holding the air from upward displacement, any air initially in the conduit 74 would be rapidly displaced with water). The air pump 75 shown at the lower reaches of the conduit 74 could obviously be disposed at the upper reaches or even beyond the conduit 74 and operate by blowing action or other, provided air is driven down through the conduit 74.

As part of the air 69 is released through the valve 80 and leaves the lower chamber 24, and as it enters the upper chamber 26 instead, the lower air pocket 65 contracts or grows smaller, and the water level rises as more water 64 enters through the downwardly-facing mouth or open bottom end 34 of the lower chamber 24, and in the upper chamber 26 the water level is lowered as water 64 is displaced by the enlarging air pocket 67 in the upper chamber. This is best seen in a comparison between FIG. 2 and FIG. 3. In the lower chamber 24, the buoyant element 44 therein rises with the water level, and the piston 54 rises with the buoyant element 44. The piston 54 in the lower chamber 24 therefore has moved from a relatively high position in the repose mode of FIG. 1, to a lower position in the first-chamber pressurized mode of FIG. 2 (expanded air pocket 65 in the lower chamber 24), and then the piston 54 in the lower chamber 24 has moved back upwardly, and is disposed back at its relatively high position in the lower chamber 24 in the second-chamber pressurized mode of FIG. 3. This is a single cycle of the reciprocating motion of a piston, here the piston 54 of the lower chamber 24, of the present invention.

Also seen in a comparison between FIG. 2 and FIG. 3, the buoyant element 46 in the upper chamber 26 is lowered as water 64 is displaced from the upper chamber by the expanded air pocket 67 above the water level. The piston 56 in the upper chamber is lowered with the lowering of its buoyant element 46, as seen in FIG. 3. An upper-chamber valve 82 then releases air from its air pocket 67, which air rises through the housing 12 until it is released to atmosphere 66. Again, not all of the air in the air pocket 67 of the upper chamber 26 is released, but instead just a sufficient amount of air is released to return the air pocket 67 of the upper chamber 26 to its original volume. This action is the same as described and illustrated for the lower chamber 24 and will not, and need not, be re-described in detail nor illustrated.

In actual practice, the release of delivered air 69 from the air conduit 74 would be repetitious, and the valves 80, 82 of the first and second chambers 24, 26 would intermittently open and close, releasing air upwardly and halting such air release, in response to the level of the respective buoyant element 44, 46, or instead track another delivered-air dependent parameter, such as the volume of delivered-air passing a given point at a given time, or for a known air-flow per unit time system, the passage of time. In any event, the pistons 54, 56 would typically be substantially constantly reciprocating rather than dwelling in a repose mode for any amount of time other than momentarily. 100271 The device 10 is shown in FIG. 1 to FIG. 3 in association with elements converting or transforming the kinetic energy of the substantially vertically-reciprocating motion into another energy form, namely here electricity. Shown in FIG. 1 to FIG. 3 are electric generators 92, 94 associated with respectively chambers 24, 26. As shown, the electric generators 92, 94 are mounted with the respective chambers 24, 26, and mechanically linked to the adjacent pistons 54, 56 by linkage rods or elements 93, 95 which sufficiently are embedded or extend within the respective generators 92, 94 to induce electric current flow, by conventional and well known mechanisms. The electric currents so generated run through electric current feeder lines 96, 98 each to a main electric current line 97 which runs upward and out to a conventional electric current storage and/or electric current use facility (not shown). The housing 12

The device of the present invention is of course not limited to the two chambers, or the single buoyant and tailed elements per chamber, or other structural minutiae of the embodiment illustrated in FIG. 1 to FIG. 3 and described above. The device of the present invention may include numerous vertically aligned (or stacked) chambers, a plurality of tailed buoyant elements and the chambers may be open to water and delivered air from below through valves or narrow inlets and the like. For instance, there is no theoretical limitation on the number of stacked (disposed at different vertical heights) buoyant elements, and instead the numerical selection is more a matter of preference and site and/or construction practicalities. Further the compartments need not be chambers disposed within a housing such as seen in the embodiment illustrated in FIG. 1 to FIG. 3 and described above. Further, the device of the present invention does not exclude side-by-side stacks, and in such embodiments the individual stacks can be served by a single air conduit having a plurality of outlets. These and other variations are illustrated in FIG. 4 and are described blow.

Figure 4:
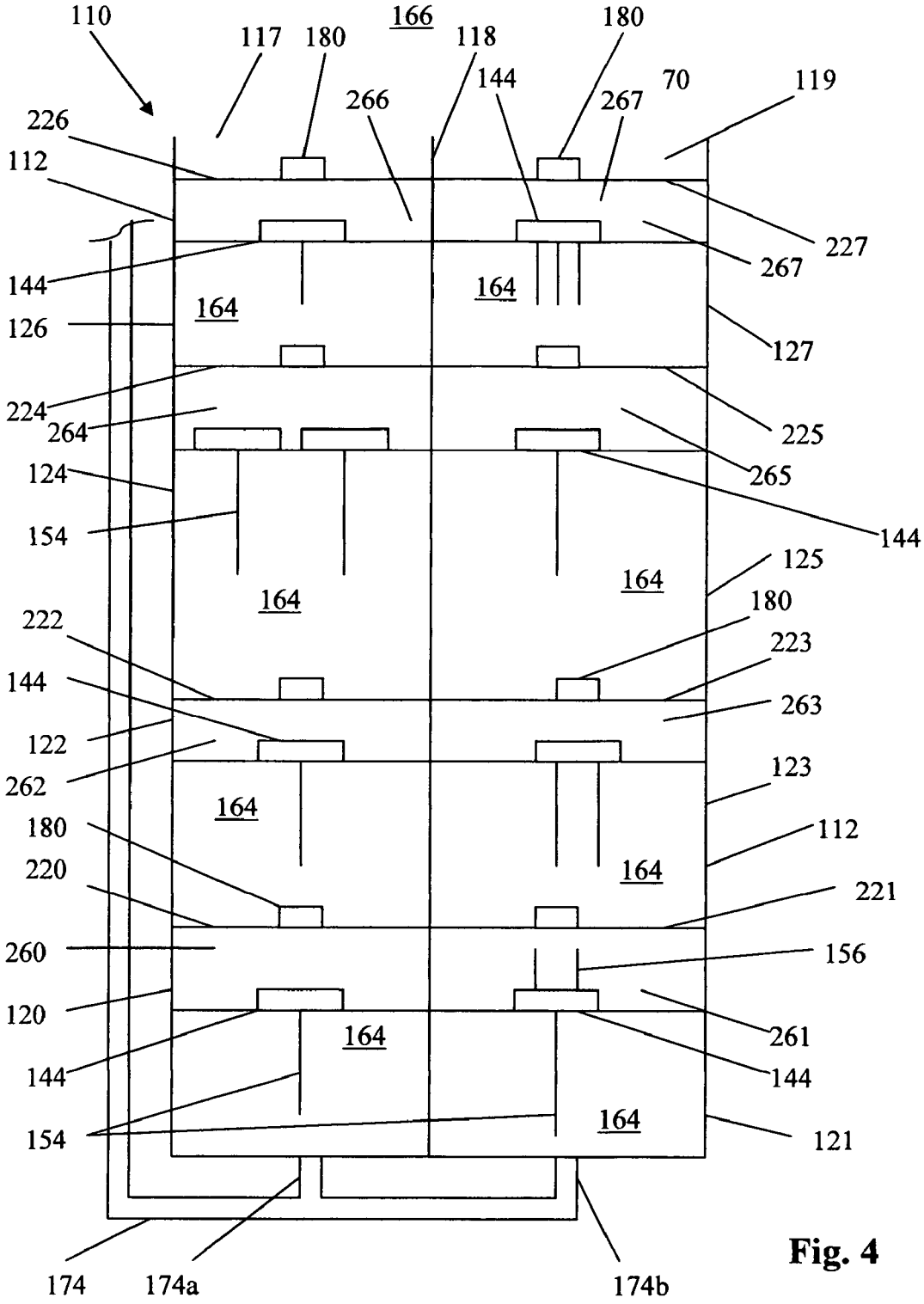
FIG. 4 is a diagrammatic view of a device of the present invention in a repose mode.

The device 110 of the embodiment of the invention shown in FIG. 4 has external casing or housing 112 which is partitioned into two vertical tiers, namely a first and a second tier 117, 119, each of which houses a vertical stack of tailed buoyant elements. The housing 112 has an oblong horizontal profile which is bisected by a single center partition 118. The device 110 could instead be formed as two cylindrical housing members, connected or otherwise secured for side-by-side arrangement, and of course any desired horizontal profile can be employed. The housing 112 of the device 110 shown in FIG. 4 and 5 is substantially water-impermeable and water-impervious, and in preferred embodiments is not substantially affected by prolonged immersion in water. The housing 112 therefore is preferably constructed from a suitable non-porous and sufficiently rigid material, or combination of materials, such as plastic, metal, metal alloy, wood, ceramic, glass and the like which are water-resistant or waterproof, such as by being naturally water-resistant or waterproof or having a sufficiently water-resistant or waterproof coating or finish. The housing 112 also is sufficiently rigid to substantially retain a sufficient degree of structural integrity under the conditions of its use in the practice of the method of the present invention.

Each tier 117, 119 is divided into a series of stacked compartments, namely the first, second, third and fourth compartments 120, 122, 124, 126 in the first tier 117 and the first, second, third and fourth compartments 121, 123, 125, 127 in the second tier 118, by the first, second, third and fourth compartment dividers 220, 222, 224, 226 in the first tier 117 and the first, second, third and fourth compartment dividers 221, 223, 225, 227. Each of the compartment dividers 220, 222, 224, 226, 221, 223, 225, 227 is substantially and sufficiently water-tight to prevent any significant seepage of water 164 from the respective compartment above the divider down into the respective compartment below the divider. Each of the compartment dividers 220, 222, 224, 226, 221, 223, 225, 227 has an air pocket below it, namely the first, second, third and fourth air pockets 260, 262, 264, 266 in the first tier 117 and the first, second, third and fourth air pockets 261, 263, 265, 267 in the second tier 118. Each compartment divider is sufficiently rigid to maintain the integrity of the compartment below it. In other words, if any compartment divider was overly elastic, it would droop down excessively under the weight of the water 164 above it into the compartment below it.

Each of the compartment dividers 220, 222, 224, 226, 221, 223, 225, 227 is of course spaced-apart from adjacent compartments in the respective tier so as to form the first, second, third and fourth compartments 120, 122, 124, 126 in the first tier 117 and the first, second, third and fourth compartments 121, 123, 125, 127 in the second tier 118, and each of such compartments holds an air pocket as noted above and water 164 on which one or more buoyant elements 144 float, and each of the buoyant elements 144 has one or more downward tails (rods, pistons) 154 and/or one or more upward tails 156. In more detail, as shown particularly in FIG. 4, the first, second, third and fourth compartments 120, 122, 124, 126 in the first tier 117 contain respectively buoyant elements 144 having, in order, one downward tail 154, one downward tail 154, two buoyant elements 144 each with a downward tail 154 and one (shorter) downward tail 154. The first, second, third and fourth compartments 121, 123, 125, 127 in the second tier 118 contain respectively, in order, buoyant element 144 with one downward tail 154 and two upward tails 156, two downward tails 154, one downward tail 154, and three downward tails.

Mounted on each of the compartment dividers 220, 222, 224, 226, 221, 223, 225, 227 are valves 180 which operate as described above for valves 80 of the embodiment of FIG. 1 to FIG. 3. Mounted along, and outside of, the housing 112 is an air conduit 174 which differs from the air conduit 74 of FIG. 1 to FIG. 3 in that it opens at its lower end to two air delivery ducts, namely duct 174*a* and duct 174*b* which serve respectively the first tier 117 and the second tier 119.

Not shown in FIG. 4 nor described above are the air pump nor the associated structures such as linkage rods, electric generators and electric current transmission lines, which are the equivalents of the structure illustrated in FIG. 1 to FIG. 3 and described above. Each piston or "tail" can be linked to an electric generator, which can be the same generator or separate generators. The electric current flow from the generators can feed into a primary transmission line or there can instead be multiple transmission lines running to electricity storage or usage facilities. The construction basics of the buoyant elements and their respective tails (rods, pistons) and the operational basics of the device 110 illustrated in FIG. 4 are also essentially the same as the construction basics and the operational basics of the device 10 described above, and will not be repeated here. Also not shown or described herein are means to power the air pumps or fasteners/fastening means for mounting components or holding them in operable association or the operational and/or construction details of the electric generators and/or valves. All of these and other details are well within the skill of a person of ordinary skill in the art.

Certain Further Delineations

The body or central part of the device is usually immersed in water, and usually only the air line(s) that run to, and the power line(s) that lead away from, the device traverse the water/atmosphere interface. The immersion water must be of sufficient volume or capacity to contain the device, and can be water within a natural body of water, such as a lake or an ocean, or artificially confined water, such as the water within a fabricated columnar structure or other. The immersion water need not be completely still or static, but should be sufficiently still or static to avoid any adverse impacts on the device, such as, without limitation, the dislodging or the dislocation of components, the rupturing of components and any undue disruption of the intended or desired movements of the buoyant elements.

The chambers can have open bottoms such as shown for the chambers 24, 26 of FIG. 1, or they can have closed bottoms, for instance bottoms bridged by air lines or the like. In any event, each chamber must in some manner be open to air, or air flows, usually rising up from lower elevations through open or closed water pathways. The chambers of course must be constructed to withstand external forces, and external forces, such as external water pressure in the case of submerged chambers, can vary from chamber to chamber depending on a chamber's position in a vertical alignment. Chambers in any given vertical alignment of course may be larger or smaller than the other chambers, may have a greater or lesser proportion of their internal volume occupied by water than the other chambers, and may have larger or small buoyant elements than the other chambers.

The present invention, as illustrated in FIG. 1 to FIG. 4 and in broad embodiments, is a device for generating substantially vertically-reciprocating motion when in a substantially liquid-loaded posture. A liquid-loaded posture includes without limitation immersion of the device in liquid and the device being filled with liquid (except of course for air pockets and amounts of delivered air). A liquid-loaded posture is any mode of water (or other liquid) association sufficient to float a buoyant element in water (or other liquid) which bounds an air (or other gas) pocket. Such device is comprised of: (1) a first and a second chamber; (b) a first and a second buoyant element; and (c) a gaseous-material conduit adapted for regulated release of the gaseous material to the first chamber. (Such device may also include as many other chambers as is desired or practical.) The first chamber is (i) open to admissions and expulsions of the liquid, (ii) adapted to envelope a first gaseous-material pocket above a liquid, (iii) adapted to receive gaseous material released from the gaseous-material conduit, and (iv) adapted for regulated release of the gaseous material to the second chamber. The second chamber is (v) open to admissions and expulsions of the liquid, adapted to envelope a second gaseous-material pocket above the liquid, (vi) adapted to receive gaseous material released from the first chamber, and (vii) adapted for regulated release of the gaseous material. The first buoyant element is disposed within the first chamber and is adapted to float on the liquid in the first chamber when the second first chamber envelopes the first gaseous-material pocket. The second buoyant element is disposed within the second chamber and is adapted to float on the liquid in the second chamber when the second chamber envelopes the second gaseous-material pocket.

In certain preferred embodiments, the device of the present invention further includes a housing adapted to shield the first and the second chambers when the first and the second chambers are immersed in a body of the liquid. In other preferred embodiments, separately and in combinations, the gaseous material is air, the liquid is water, the buoyant elements are separately comprised of a buoyant member and a downwardly extending piston member affixed to the buoyant member, the device further includes at least one electric generator adapted to be driven by vertically-reciprocating motion of at least one of the first and second buoyant elements.

As indicated above, the device may include a set of chambers, wherein each chamber in the set is open to admissions and expulsions of the liquid, is adapted to envelope a gaseous-material pocket above the liquid, is adapted to receive gaseous material released from an neighboring chamber, and is adapted for regulated release of the gaseous material, and each chamber in the set separately has at least buoyant element disposed within and is adapted to float on the liquid in the chamber when the chamber envelopes the gaseous-material pocket. The lowest chamber of course receives the delivered gaseous material not from a lower chamber (because there is none) but instead from a gaseous-material delivery conduit. Similarly, the device may include a plurality of vertical alignments of chambers, which alignments may be disposed side-by-side or otherwise. The device may have a plurality of electric generators, including an electric generator for each buoyant element, and an electric current transmission system adapted to receive the electric currents, and typically to transmit such current or currents to a remote location for use and/or storage.

The present invention is also a method for generating substantially vertically-reciprocating motion using the device of the present invention, as described and illustrated above in reference to FIG. 1 to FIG. 4. In broad embodiments, such method is comprised of the steps of: (1) disposing the gaseous-material conduit, the first chamber and the second chamber for sequential receipt of delivered gaseous material upon sequential release of delivered gaseous material; (2) providing the liquid and a first gaseous-material pocket above the liquid in the first chamber, the first gaseous-material pocket and the liquid forming a first air/liquid interface, whereby the first buoyant element floats at the first air/liquid interface; (3) providing the liquid and a second gaseous-material pocket above the liquid in the second chamber, the second gaseous-material pocket and the liquid forming a second air/liquid interface, whereby the second buoyant element floats at the second air/liquid interface; (4) then (sequential step 1) releasing delivered gaseous material from the gaseous-material conduit, whereby the delivered gaseous material is received by the first chamber, the first gaseous-material pocket expands, the first air/liquid interface is lowered and first buoyant element is lowered together with the first air/liquid interface; (5) then (sequential step 2) releasing delivered gaseous material from the first gaseous-material pocket of the first chamber, whereby the first gaseous-material pocket contracts, the first air/liquid interface is raised and first buoyant element is raised together with the first air/liquid interface, and whereby the delivered gaseous material is received by the second chamber, the second gaseous-material pocket is expanded, the second air/liquid interface is lowered and second buoyant element is lowered with the second air/liquid interface, whereby the delivered gaseous material is received by the first chamber, the first gaseous-material pocket is expanded, the first air/liquid interface is lowered and first buoyant element is lowered with the first air/liquid interface; and (6) then repeating sequential step 1 and sequential step 2.

In certain preferred embodiments of the method, the gaseous material is air and the liquid is water. In certain embodiments, the method includes the step of immersing the device in the liquid before the sequential steps, and optionally shielding the first and second chambers (and other chambers that may be included) with a vertically-running housing, such as described and illustrated above in reference to FIG. 1 to FIG. 3.

The method for generating substantially vertically-reciprocating motion may also be include the steps of driving an electric generator by vertically-reciprocating motion of at least one of the first and second buoyant elements, whereby an electric current flow is induced, and transmitting the electric current flow to a location remote from the device, as described and illustrated above in reference to FIG. 1 to FIG. 4.

The method of he present invention may also include the steps of: disposing a plurality a chambers in the set of chambers for sequential receipt of air upon sequential release of delivered air; separately providing a plurality of the chambers in the set of chambers with an air pocket; then after (sequential step 2) releasing delivered air from the second gaseous-material pocket of the second chamber to the neighboring chamber; and releasing delivered air released from the highest chamber to atmosphere.

The method of the present invention may also be delineated by the steps of: (a) separately providing air pocket in each of the chambers whereby the air pockets and the water in each chamber separately form air/water interfaces and the buoyant elements separately float at the air/water interfaces; (b) then sequentially releasing and receiving quantities of delivered air from the delivered air conduit upward through the alignment of chambers, whereby, upon each receipt of a quantity of delivered air and subsequent release of a quantity of delivered in by and from each chamber, each respective air pocket expands and contracts, and each air/water interface is lowered and raised, and each buoyant member is lower and raised together with its associated air/water interface, whereby vertically-reciprocating motion is produced in each buoyant element. The optional, and in some circumstances, preferred additional steps include driving the electric generators with the vertically-reciprocating motions of the buoyant elements, whereby electric current flows are induced, and transmitting the electric current flows to a location remote from the device.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. A device for generating substantially vertically-reciprocating motion when in a substantially liquid-loaded posture, comprising:

a first and a second chamber;

a first and a second buoyant element; and a gaseous-material conduit open to said first chamber;

said first buoyant element being disposed within said first chamber and being comprised of a first buoyant member and a first downwardly extending piston member affixed to said first buoyant member, said second buoyant element being disposed within said second chamber and being comprised of a second buoyant member and a second downwardly extending piston member affixed to said second buoyant member, said first chamber being open to fluid flow below said first buoyant member and being open to fluid flow above said first buoyant member through a first valve having a first fluid-release point, said second chamber being disposed vertically above said first chamber, being open to fluid flow below said second buoyant member and being open to fluid flow above said second buoyant member through a second valve having a second fluid-release point.

2. A device for generating substantially vertically-reciprocating motion when in a substantially liquid-loaded posture according to claim 1, further including a housing having a bottom and a top end, said housing disposed shielding said first and said second chambers and open to fluid flow at said bottom and said top end.

3. A device for generating substantially vertically-reciprocating motion in a substantially liquid-loaded posture according to claim 1, further including at least one electric generator mechanically linked to at least one of said first and second buoyant elements.

4. A device for generating substantially vertically-reciprocating motion in a substantially liquid-loaded posture according to claim 1, further including a set of chambers, each chamber in said set separately having at least one buoyant element disposed within wherein said second chamber is a member of said set of chambers.

5. A device for generating substantially vertically-reciprocating motion in a substantially liquid-loaded posture according to claim 1, wherein said first and second chambers each separately comprise a motion-generating cell and said motion-generating cells in combination comprise a first vertical alignment of motion-generating cells, and said device further includes a second vertical alignment of motion-generating cells.

6. A device for generating substantially vertically-reciprocating motion in a substantially liquid-loaded posture according to claim 1, further including;

a first electric generator mechanically linked to said first buoyant element;

a second electric generator mechanically linked to said second buoyant element; and an electric current transmission system operably associated with at least one of said electric generators.

7. A method for generating substantially vertically-reciprocating motion using a device having a first and a second chamber, a first buoyant element comprised of a first buoyant member and a first downwardly extending piston member and a second buoyant element comprised of a second buoyant member and a second downwardly extending piston member, said first and second buoyant members disposed respectively within said first and second chambers, a gaseous-material conduit open to said first chamber, said first chamber being open to fluid flow below said first buoyant member and being open to fluid flow above said first buoyant member through a first valve having a first fluid-release point, said second chamber being disposed vertically above said first chamber, open to fluid flow below said second buoyant member and from said first fluid-release point, and being open to fluid flow above said second buoyant member through a second valve having a second fluid-release point, comprising the steps of:

(preliminary step 1) submerging said first and second buoyant elements and said first and second chambers in a liquid;

(preliminary step 2) providing a first gaseous-material pocket above said liquid in said first chamber, said first gaseous-material pocket and said liquid forming a first air/liquid interface, whereby said first buoyant element floats at said first air/liquid interface;

(preliminary step 3) providing a second gaseous-material pocket above said liquid in said second chamber, said second gaseous-material pocket and said liquid forming a second air/liquid interface, whereby said second buoyant element floats at said second air/liquid interface; then reciprocally expanding and contracting said first and second gaseous-material pockets and raising and lowering said first and second air/liquid interface and said first and second buoyant member by the repetitiously performing the sub-steps of (sub-step 1)releasing delivered gaseous material from said gaseous-material conduit to said first chamber, whereby said first gaseous-material pocket expands, said first air/liquid interface is lowered and first buoyant element is lowered together with said first air/liquid interface;

(sub-step 2) releasing delivered gaseous material from said first gaseous-material pocket of said first chamber to said second chamber, whereby said first gaseous-material pocket contracts, said first air/liquid interface is raised and first buoyant element is raised together with said first air/liquid interface, and whereby said second gaseous-material pocket is expanded, said second air/liquid interface is lowered and second buoyant element is lowered together with said second air/liquid interface; and (sub-step 3) releasing delivered gaseous material from said second chamber, whereby said second gaseous-material pocket contracts, said second air/liquid interface is raised and second buoyant element is raised together with said first air/liquid interface.

8. A method for generating substantially vertically-reciprocating motion according to claim 7 wherein said gaseous material is air and said liquid is water.

9. A method for generating substantially vertically-reciprocating motion according to claim 7 further including the step shielding said first and second chambers with a vertically-running housing before said sub-step 1.

10. A method for generating substantially vertically-reciprocating motion according to claim 7 wherein said device further including at least one electric generator mechanically linked to at least one of said first and second buoyant elements, further including the steps of:

driving said electric generator by vertically-reciprocating motion of at least one of said first and second buoyant elements, whereby an electric current flow is induced, and transmitting said electric current flow to a location remote from said device.

11. A method for generating substantially vertically-reciprocating motion according to claim 7, wherein said device further includes a plurality of electric generators, each generator separately operably associated with at least one of said buoyant elements, further including the steps of:

driving said electric generators with said vertically-reciprocating motions of said buoyant elements, whereby electric current flows are induced, and transmitting said electric current flows to a location remote from said device.

* * * * *